United States Patent [19]

McHenry, Jr.

[11] 4,108,293

[45] Aug. 22, 1978

[54] DRIVE DISCONNECT DEVICE FOR A CLOTH SPREADING MACHINE

[75] Inventor: Joe M. McHenry, Jr., Hendersonville, Tenn.

[73] Assignee: Cutters Machine Company, Inc., Nashville, Tenn.

[21] Appl. No.: 761,814

[22] Filed: Jan. 24, 1977

[51] Int. Cl.[2] ..... B60L 5/12

[52] U.S. Cl. ..... 192/67 R; 403/1; 270/31

[58] Field of Search ..... 192/67 R, 95; 270/31; 403/1

[56] References Cited

U.S. PATENT DOCUMENTS

| | | | |
|---|---|---|---|
| 1,836,773 | 12/1931 | Salerni | 192/67 R |
| 2,631,457 | 3/1953 | Gilbert et al. | 270/31 |
| 2,756,992 | 7/1956 | Rosenthal | 270/31 |

*Primary Examiner*—Gerald A. Dost

*Attorney, Agent, or Firm*—Harrington A. Lackey

[57] ABSTRACT

A cloth spreading machine having a manually operable disconnect device for drivingly disconnecting the drive motor and the drive wheel, including a pair of clutch members rotatably mounted upon a drive shaft, one clutch member having a keyway adapted to be aligned with and to receive an elongated key upon the shaft when the clutch member is manually rotated between operative and inoperative positions.

4 Claims, 6 Drawing Figures

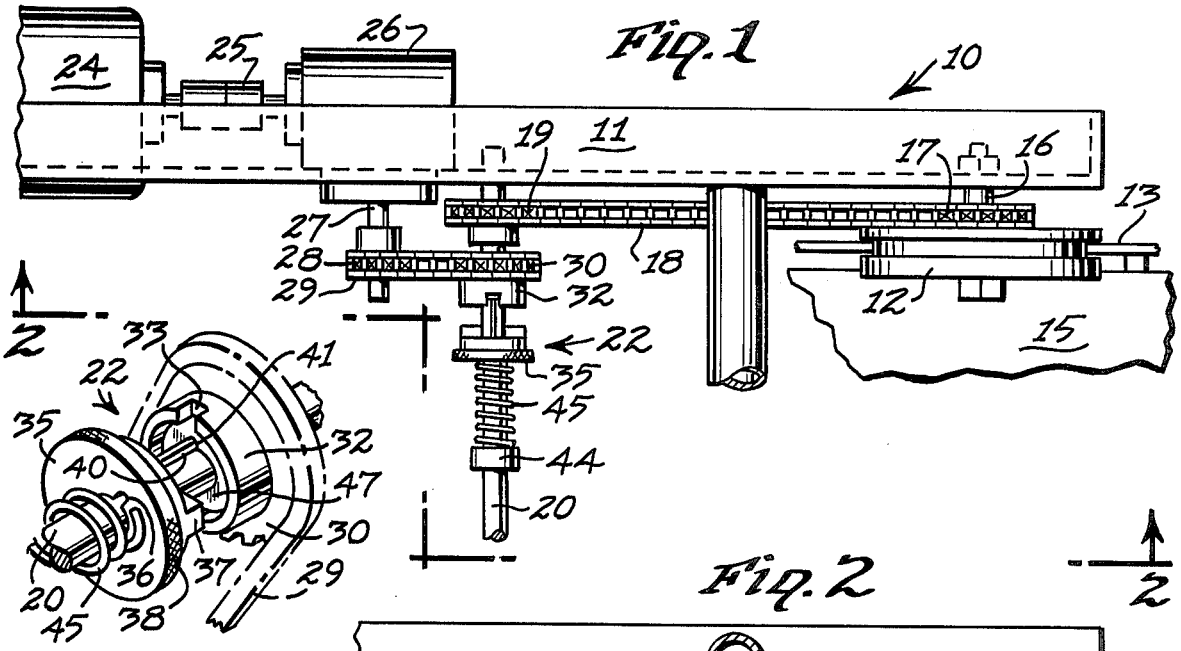
Fig. 1
Fig. 2
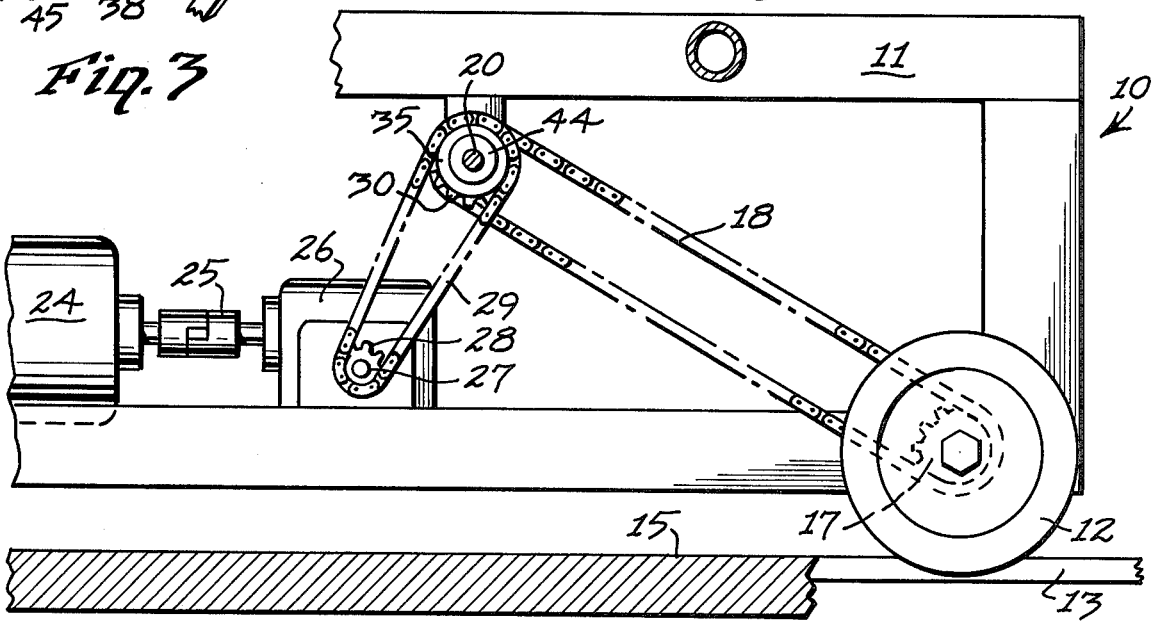
Fig. 3
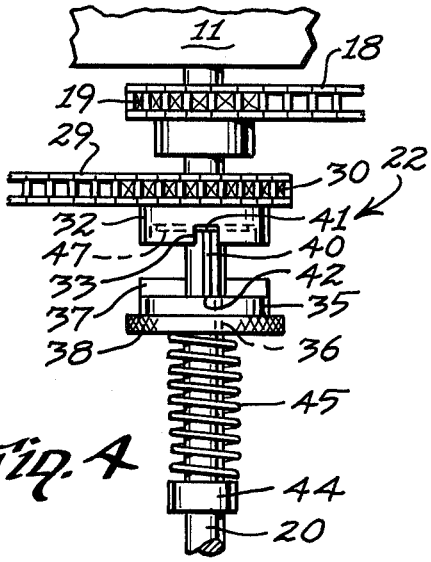
Fig. 4
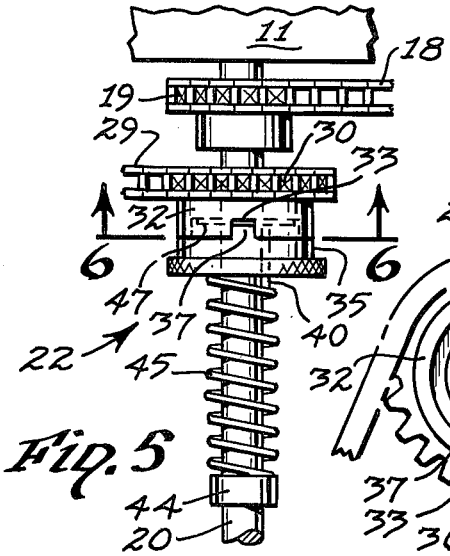
Fig. 5
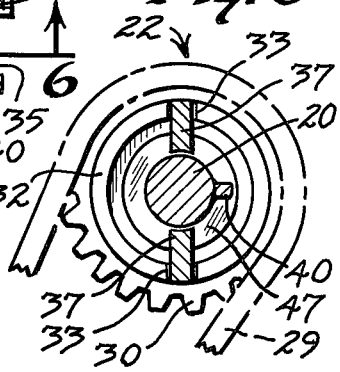
Fig. 6

DRIVE DISCONNECT DEVICE FOR A CLOTH SPREADING MACHINE

BACKGROUND OF THE INVENTION

This invention relates to a cloth spreading machine, and more particularly to a cloth spreading machine having a manually operable drive disconnect device.

Heretofore, in cloth spreading machines having motor-driven wheels, it has been extremely difficult to move the machine without energizing the drive motor.

Occasinally it is desirable to move the machine short distances, such as for aligning the edge of the cloth on the machine with the edges of the stacked layers of cloth upon the cutting table, before starting the drive motor to move the frame for actually laying the cloth.

Sometimes it is desirable to be able to manually push or move the spreading machine where there has been a power failure, or where power is unavailable, such as in moving the cloth spreading machine from one room to another or from one cutting table to another. In all of these situations, where the wheels of the machine frame are drivingly connected to the motor and the motor is not energized, any manual movement of the machine frame must be effected against the inertia of the entire transmission system as well as the motor itself.

SUMMARY OF THE INVENTION

It is therefore an object of this invention to provide a cloth spreading machine having a manually operable disconnect device for readily and quickly disconnecting the drive motor from the drive wheel or wheels, whenever it is desired to "free-wheel" the machine frame from one loaction to another.

In the manually operable drive disconnect device made in accordance with this invention, a pair of clutch members having cooperable clutch faces are rotatably mounted upon a drive shaft, such as the cross drive shaft in the transmission system of the cloth spreading machine. A first transmission means, such as a sprocket and chain transmission couples the drive shaft to the drive wheel for simultaneous rotation. The first clutch member is freely rotatably mounted upon the shaft and is also coupled through a second transmission means, such as a second sprocket and chain transmission, to the drive motor, preferably through a gear reducer. The second clutch member is also normally freely rotatably mounted upon the drive shaft proximate to the first clutch member. The second clutch member is provided with a keyway adapted to be aligned with, and to slidably receive, an elongated key fixedly mounted upon the drive shaft between the clutch members, when the second clutch member is rotated upon the shaft to a predetermined position. A spring on the rotary shaft normally biases the second clutch member toward the first clutch member.

Thus, when the second clutch member is manually rotated upon the shaft until its keyway is aligned with the key, the second clutch member is free to axially slide along the shaft toward the first clutch member until its clutch face drivingly engages the clutch face of the first clutch member, to drivingly connect the wheel to the drive motor.

When it is desired to disengage the drive motor from the wheel of the spreading machine, the second clutch member is manually moved away from the first clutch member, against the action of the biasing spring, until it has cleared the key, at which position the second clutch member is rotated to disalign the keyway with the key. The spring then holds the clutch member in its inoperative position frictionally against one end of the key so that only the drive shaft rotates with the wheel, and the drive motor is maintained drivingly disconnected from the wheel. When the machine is pushed with the clutch members in their inoperative positions, the wheel and drive shaft will rotate and the frictional engagement between the key and the second clutch member will cause the second clutch member to rotate with the drive shaft.

BRIEF DESCRIPTION OF THE DRAWINGS

FIG. 1 is a fragmentary, top plan view of a portion of a cloth spreading machine on the proximal side, or on the operator's side, of the cutting table, disclosing the disconnect device in its inoperative position;

FIG. 2 is a fragmentary section taken along the line 2—2 of FIG. 1, with a portion of the cutting table broken away;

FIG. 3 is a top perspective view of the disconnect device in its inoperative position;

FIG. 4 is an enlarged, fragmentary, plan view of the disconnect device disclosed in its inoperative position;

FIG. 5 is a view similar to FIG. 4 disclosing the disconnect device in its operative position; and FIG. 6 is an enlarged section taken along the line 6—6 of FIG. 5.

DESCRIPTION OF THE PREFERRED EMBODIMENTS

Referring now to the drawings in more detail, the cloth spreading machine 10 made in accordance with this invention includes a frame or machine frame 11 supported by grooved wheels, such as the grooved drive wheel 12 on the proximal side of the machine, that is the side of the machine closest to the operator, for movement along a track or rail 13 mounted on the side of the cutting table 15. The opposite or remote side of the machine 10 is supported by smooth-surfaced wheels, not shown, for rolling movement over the top surface of the spreading or cutting table 15, in a conventional manner.

Fitted concentrically upon the axle 16 of the drive wheel 12 is a driven sprocket 17. A chain 18 is trained about the sprocket 17 and a sprocket 19 fixed to the cross drive shaft 20. The cross drive shaft 20 extends to the opposite side of the machine where it is similarly coupled by a sprocket and chain transmission to the smooth-surfaced wheel, not shown, opposite the drive wheel 12 in a conventional manner.

The drive disconnect device 22 is designed to selectively couple and uncouple the drive shaft 20 with the drive motor 24 mounted on the frame frame 11. The motor 24 is connected through drive coupling 25 to a gear reducer 26. The driven shaft 27 of the gear reducer 26 supports a drive sprocket 28. A transmission chain 29 is trained about the drive sprocket 28 and a driven sprocket 30 mounted upon a first clutch member 32 having a clutch face with diametrically aligned slots or recesses 33 therein. The first clutch member 32 is mounted to freely rotate about the drive shaft 20.

Also rotatably mounted upon the drive shaft 20 is a second rotary clutch member 35 having an axial keyway 36 extending completely through the thickness or length of the second clutch member 35. The clutch face of the rotary clutch member 35 comprises diametrically aligned projecting dogs 37 adapted to register with the corresponding slots 33 in the first clutch member 32. The circumference of the second clutch member 35 is also provided with a knurled surface to facilitate manual gripping and rotation of the second clutch member relative to the rotary shaft 20.

Fixed upon the surface of the drive shaft 20 and extending parallel to the rotary axis of the drive shaft 20 is an elongated key 40 of limited length and terminating in an outboard end 41 and an inboard end 42. The key 40 is adapted to register with and be slidably received in the keyway 36, when the keyway 36 and the key 40 are axially aligned.

Coiled about the drive shaft 20 between a collar 44 and the inner face of the second clutch member 35 is a coil spring 45, compressed to constantly bias the second clutch member 35 toward the first clutch member 32.

In the operation of the cloth spreading machine 10, the disconnect device 22 is normally in its operative position in which the clutch members 32 and 35 are engaged, as disclosed in FIG. 5. In the operative position, each slot 33 on the clutch face of the first clutch member 32 positively engages a corresponding dog 37 on the clutch face of the second clutch member 35. Furthermore, in the operative position, since the keyway 36 is in alignment with the key 40, the spring 45 urges the second clutch member 35 toward the first clutch member 32 so that not only does each dog 37 engage a registering slot 33, but the key 40 slidably engages the keyway 36 to rotatably lock the second clutch member 35 to the drive shaft 20. Thus, with the second clutch member 35 locked to the drive shaft 20 and the first and second clutch members locked together, the drive shaft 20 will be rotatably driven when the motor 24 is energized, in order to rotatably drive the drive wheel 21, and thus move the frame 11 along the cutting table 15. When the drive motor 24 is de-energized, the machine frame 11 will decelerate and stop.

Now, when it is desired to manually push the frame 11 along the cutting table 15 when the motor 24 is de-energized, the operator grasps the knurled surface 38 and axially moves the second clutch member 35 inward along the shaft 20 until the second clutch member 35 has cleared the inboard end 42 of the key 40. Then the operator rotates the clutch member 35 in either direction until the keyway 36 is disaligned with the key 40. The operator then releases the knurled surface 38 causing the spring 45 to urge the second clutch member 35 into frictional engagement against the inboard end 42 of the key 40. Thus, the clutch members 32 and 35 will remain disengaged in their inoperative positions. Should the motor 24 be energized while the clutch members are in their inoperative positions, only the first clutch member 32 will be rotated freely about the stationary shaft 20.

Furthermore, with the motor 24 de-energized, if the machine frame 11 is pushed manually in either direction, the wheel 12 will rotate causing the sprocket 17, chain 18 and sprocket 19 to drive the drive shaft 20 in a simultaneous rotary motion. As the cross drive shaft 20 rotates, the key 40 will also rotate with the shaft 20. By virtue of the frictional engagement between the inboard end 42 of the key 40 and the second clutch member 35, the second clutch member 35 will also be rotated with the key 40 so that the keyway 36 and key 40 will be maintained in their relative disaligned positions to hold the second clutch member 35 out of engagement with the first clutch member 32. The first clutch member 32 will remain stationary while the shaft 20 rotates coaxially within the loose-fitting first clutch member 32.

When it is desired to recouple the clutch members 32 and 35, the operator grasps the knurled surface 38 and rotates the second clutch member 35 to its operative position in which the keyway 36 and the key 40 are re-aligned. When the knurled surface 38 is released, the spring 45 automatically forces the second clutch member 35 axially outboard along the shaft 20 guided by the keyway 36 and the key 40 until the clutch dogs 37 rest against the inner clutch face of the first clutch member 32. Then, when the motor 24 is started to rotate the first clutch member 32, the slots 33 will also be rotated until they are re-aligned with the dogs 37, in which event the dogs 37 will fall into the slots 33 to cause positive engagement between the first clutch member 32 and the second clutch member 35. The drive wheel 12 is now recoupled to the drive motor 24 in order to move the frame 11 along the cutting table 15.

The motive means or motor 24 mounted on the frame 11 is preferably an electrical motor energized by electrical controls and an electrical power source, not shown.

Although the first clutch member 32 is shown outboard of the second clutch member 35, it will be understood that these positions could be reversed. Furthermore, the respective clutch faces of the clutch members 32 and 35 could be reversed, so that the first clutch member 32 could be provided with the clutch dogs 37, while the second or outboard clutch member 35 could be provided with the slots 33.

Other types of transmissions than the sprocket and chain transmissions 17, 18 and 19, and 28, 29 and 30 could also be employed, such as gear trains.

Furthermore, the disconnect device 22 could be mounted upon an extended gear reducer output shaft 27, or the disconnect device 22 could be mounted upon an extended axle 16, so that the driving power between the motor 24 and the wheel 12 could be disengaged at various locations in the intervening transmission means.

The interior of the cup-shaped clutch face of the first clutch member 32 may be provided with a loose washer 47 freely rotatable about the drive shaft 20 to provide a low-friction bearing surface for the outboard end 41 of the key 40.

What is claimed is:

1. In a cloth spreading machine having a machine frame supported on wheels, including a drive wheel, for rolling movement on a cutting table, and drive motive means on the frame, a drive disconnect device comprising:

(a) a rotary drive shaft drivingly connected to said drive wheel, (b) an elongated key of limited length having an inboard end and an outboard end and fixed upon said shaft parallel to the rotary axis of said shaft, (c) a first rotary clutch member having a first clutch face, freely rotatable upon said drive shaft outboard of the outboard end of said key, and drivingly connected to said motive means, (d) a second rotary clutch member having a second clutch face for driving engagement with said first clutch face, said second clutch member being normally rotatable upon said drive shaft inboard of said first clutch member, (e) an axial keyway in said second clutch member adapted to receive said key when axially aligned with said key for non-rotatable, axial movement of said second clutch member relative to said shaft, and (f) spring means on said shaft constantly biasing said second clutch member toward said first clutch member and into frictional engagement with the inboard end of said key in an inoperative position in which said keyway is disaligned with said key.

2. The invention according to claim 1 in which one of said clutch faces comprises at least one dog and the other of said clutch faces comprises a slot registering with said dog in an operative position.

3. The invention according to claim 1 comprising first transmission means drivingly coupling said drive shaft to said drive wheel, and second transmission means drivingly coupling said first clutch member to said motive means.

4. The invention according to claim 3 in which said first transmission means comprises first sprocket and chain transmission means, and said second transmission means comprises second sprocket and chain transmission means.

* * * * *